US005617663A

United States Patent [19]

Miki et al.

[11] Patent Number: 5,617,663

[45] Date of Patent: Apr. 8, 1997

[54] THREE-DIMENSIONAL PHOTOGRAPH STAND

[75] Inventors: Yoshiharu Miki; Harukazu Miki, both of Tokyo, Japan

[73] Assignee: Miki Pulley Co., Ltd., Kanagawa-ken, Japan

[21] Appl. No.: 265,584

[22] Filed: Jun. 23, 1994

[30] Foreign Application Priority Data

| | | | |
|---|---|---|---|
| Jun. 25, 1993 | [JP] | Japan | 5-039244 U |
| Aug. 16, 1993 | [JP] | Japan | 5-048652 U |
| Sep. 27, 1993 | [JP] | Japan | 5-056314 U |
| Dec. 3, 1993 | [JP] | Japan | 5-071129 U |
| Dec. 3, 1993 | [JP] | Japan | 5-071130 U |

[51] Int. Cl.[6] ..... A47G 1/06

[52] U.S. Cl. ..... 40/738; 40/650; 40/743

[58] Field of Search ..... 40/160, 152, 152.1, 40/650, 661, 738, 743

[56] References Cited

U.S. PATENT DOCUMENTS

| | | | |
|---|---|---|---|
| 2,731,749 | 1/1956 | Tarzain | 40/160 X |
| 2,873,545 | 2/1956 | Noel | 40/160 |
| 3,041,761 | 7/1962 | Knox | 40/160 X |

FOREIGN PATENT DOCUMENTS

| | | | |
|---|---|---|---|
| 1431439 | 4/1976 | United Kingdom | 40/160 |

*Primary Examiner*—Kenneth J. Dorner
*Assistant Examiner*—Cassandra Davis
*Attorney, Agent, or Firm*—Skjerven, Morrill, MacPherson, Franklin & Friel; Thomas S. MacDonald; Alan H. MacPherson

[57] ABSTRACT

To create a three-dimensional impression from a normal two-dimensional planar photograph or picture, the photograph stand of the present invention maintains the photograph part-cylindrical, part-spherical or otherwise curved condition. It can be achieved by interposing the photograph between two curved shape retaining panels, or, alternatively, bringing the two side edges of the photograph or a resilient shape retaining panel on which the photograph is mounted closer together. The latter mode can be achieved by using suitable engagement portions or receiving the photograph in a transparent tube whose circumferential length is shorter than twice the lateral width of the photograph. By providing mirror surfaces on either side of the curved photograph, preferably with the mirror surfaces fanning out toward the front at an appropriate angle, the photograph stand can add not only a depth to the photograph but also an increased width to the photograph.

4 Claims, 19 Drawing Sheets

Fig. 1A
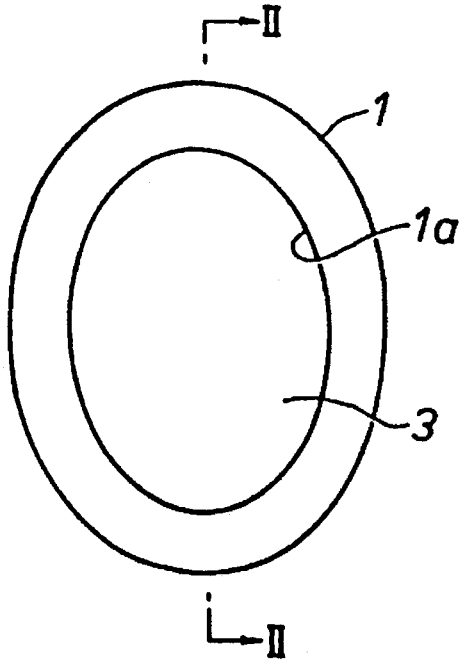
Fig. 1B
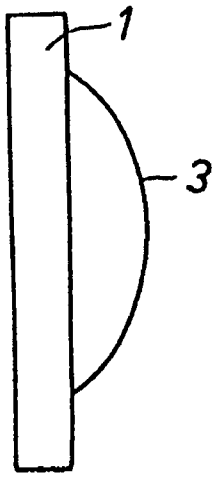
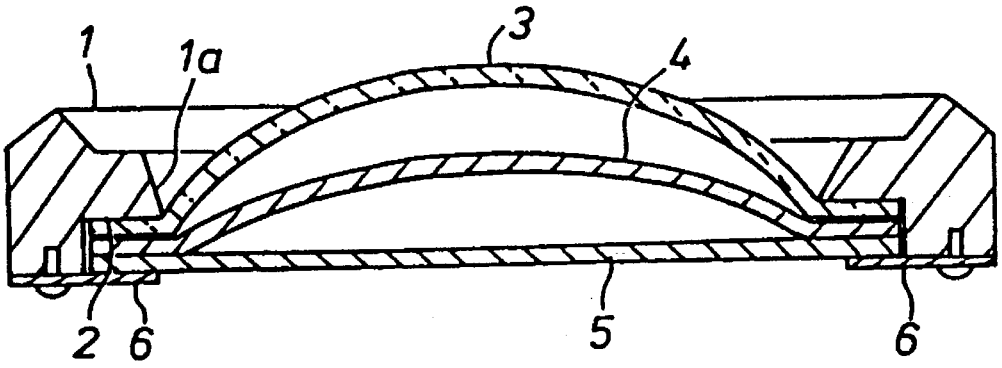
Fig. 2

Fig. 5A
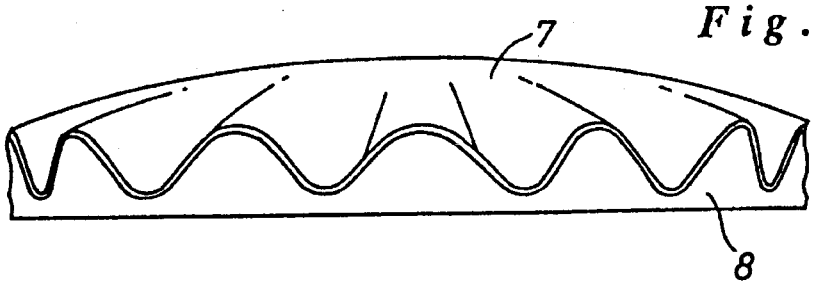
Fig. 5B
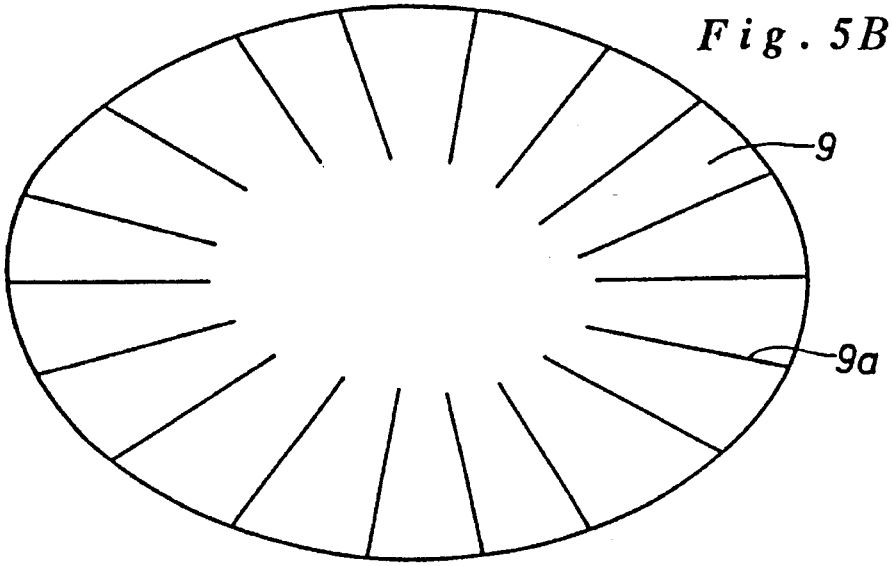
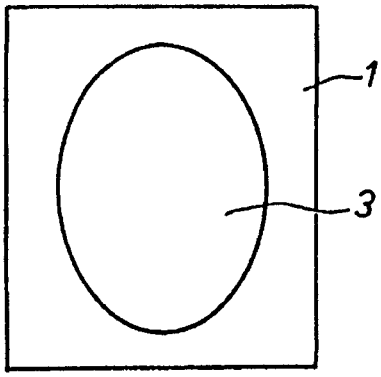
Fig. 6A
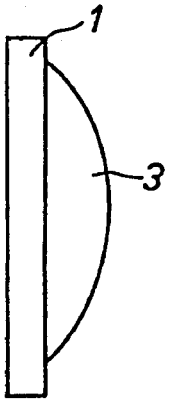
Fig. 6B 123
138
136
138
137

122
135
133
135
134

121
127
132
131
128
129
130
140

THREE-DIMENSIONAL PHOTOGRAPH STAND

TECHNICAL FIELD

The present invention relates to a photograph stand which can receive a photograph or a picture therein and can create a three-dimensional impression.

BACKGROUND OF THE INVENTION

A conventional photograph stand comprises a flat front panel consisting of transparent material such as glass, and a rear panel placed behind the front panel. The photograph is placed between the front panel and the rear panel. Such a photograph stand simply places the photograph on a plane, and therefore it is not possible to create any three-dimensional impression or give a perception of a depth to the viewer. A stereoscopic photograph can show three-dimensional images, but is not suitable for normal purpose because a special viewing apparatus is necessary.

BRIEF SUMMARY OF THE INVENTION

In view of such problems of the prior art, a primary object of the present invention is to provide a photograph stand for placing a photograph or a picture in a position suitable for viewing on a desk or on a wall which can create a three-dimensional impression by using a normal two-dimensional planar photograph or picture.

A second object of the present invention is to provide a photograph stand which is simple in structure, and can create the impression of a depth.

A third object of the present invention is to provide a photograph stand which can create the impression of an increased width as well as the impression of a depth.

A fourth object of the present invention is to provide a photograph stand which can create the impression of a depth, and has an aesthetically attractive appearance.

These and other objects of the present invention can be accomplished by providing a photograph stand for supporting a photograph or picture, comprising: a frame having an outer profile and defining a window; a support panel for mounting the photograph thereon in a fixed relation to the frame so as to show the photograph through the window; and means for maintaining the photograph in a part-spherical, part-cylindrical or otherwise curved condition with a front surface thereof defining a convex surface. If desired, instead of using external means for maintaining the photograph in a curved condition, the resiliency of the photograph sheet itself may be used for retaining its curved condition. More specifically, by bringing the two side edges of the photograph closer together against the resiliency of the photograph sheet, it is possible to deform the photograph sheet in such a manner that its front surface define a convex part-cylindrical shape.

Thus, the photograph stand can create a three-dimensional impression from a normal flat photograph in a simple and economical manner. Further, the simple structure of the photograph stand allows it to be constructed from plate members.

According to a preferred embodiment of the present invention, the support panel comprises a transparent front shape retaining panel having a concave, for instance, part-spherical rear surface and a rear shape retaining panel having a convex front surface which is substantially complementary to the concave surface for interposing the photograph between the concave and convex surfaces of the front and rear shape retaining panels, respectively, to maintain the photograph in the curved condition. For the purpose of preventing the creasing of the photograph, particularly along its outer periphery, the concave and convex surfaces of the front and rear shape retaining panels may be each provided with a complementary corrugation in a radial pattern or, alternatively, the photograph may consist of a photograph sheet having a plurality of radial slits along a circumference thereof.

As an alternate means for maintaining the photograph in a curved condition, the support panel may comprise a flexible transparent sleeve for receiving a photograph therein, a circumferential length of the transparent sleeve being shorter than twice the width of the photograph so that the photograph may be maintained in a part-cylindrical curved condition by the transparent sleeve. Thus, the photograph can be curved in a highly economical and simple manner. By suitably changing the circumferential length of the transparent sleeve relative to the lateral width of the photograph, the curvature of the photograph can be changed at will.

By providing mirror surfaces on either side of the curved photograph, preferably with the mirror surfaces fanning out toward the front at an appropriate angle, the photograph stand can add not only a depth to the photograph but also an increased width to the photograph.

BRIEF DESCRIPTION OF THE DRAWINGS

Now the present invention is described in the following with reference to the appended drawings, in which:

FIGS. 1A and B are a front view and a side view of a first embodiment of the photograph stand according to the present invention;

FIG. 2 is a sectional view taken along line II—II of FIG. 1A;

FIG. 5A is a side view of the photograph sheet which is corrugated in a radial pattern to make it conform to a spherical contour;

FIG. 5B is a front view of the photograph sheet which is provided with radial slits to make it conform to a spherical contour;

FIGS. 6A and 6B are a front view and a side view of a third embodiment of the photograph stand according to the present invention;

DETAILED DESCRIPTION OF THE PREFERRED EMBODIMENTS

Figure 3:
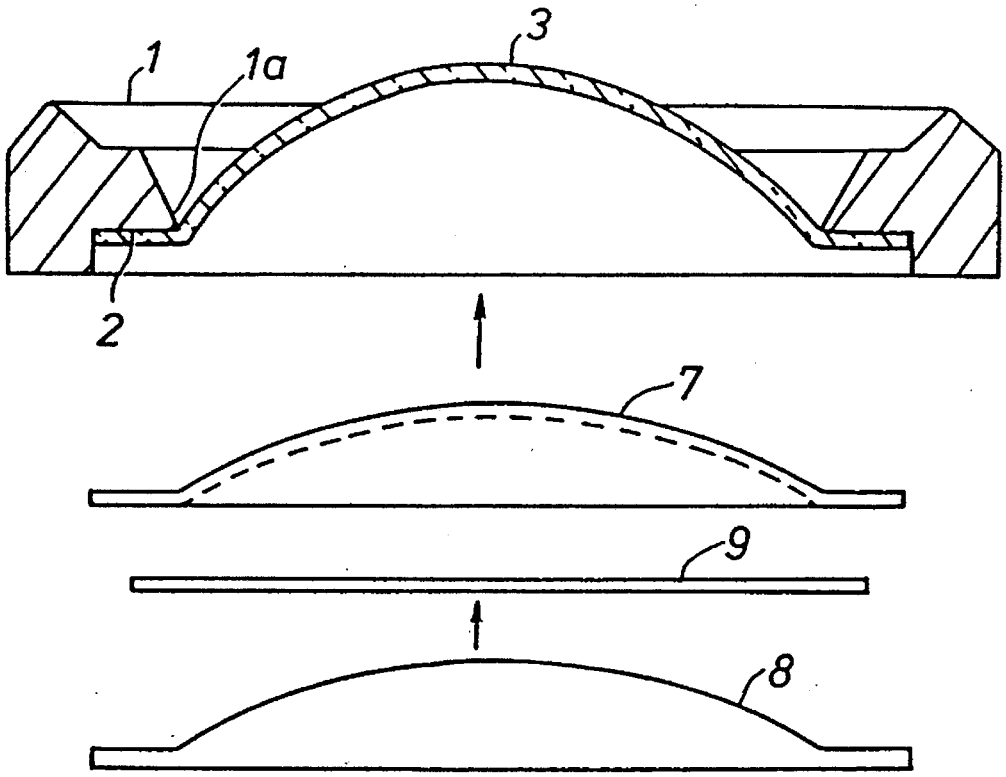
FIG. 3 is an exploded view, partly in section, of a second embodiment of the photograph stand according to the present invention.

Referring to FIGS. 1 and 2, a first embodiment of the photograph stand of the present invention comprises an elliptic frame 1 defining an elliptic window 1*a* through which a photograph shows. An annular shoulder surface 2 is defined in the part of the rear face of the frame 1 surrounding the window 1*a*, and a peripheral part of a front panel 3 having a convex front surface (and a concave rear surface) rests upon this shoulder surface 2. The front panel 3 is thus dome-shaped, and may be made of transparent plastic material or glass.

A photograph panel 4 having a convex front face is placed behind the front panel 3, and the peripheral part of the photograph panel 4 also rests upon the shoulder surface 2. The photograph panel 4 has a larger radius of curvature than the front panel 3. The photograph panel 3 may consist of a plastic plate, a paper sheet, a cardboard or the like on which a photograph is printed either before or after the photograph panel 3 is formed into the dome-shape.

A planar rear panel 5 is placed behind the photograph panel 4, and its peripheral part also rests upon the shoulder 2. A plurality of retaining pieces 6 are provided around the inner periphery of the rear surface of the frame 1, and secure the peripheral parts of the front panel 3, the photograph panel 4 and the rear panel 5 are against the shoulder surface 2. If desired, the rear panel 5 may be omitted, and the retaining pieces 6 may directly engage the peripheral part of the photograph panel 4.

Figure 4:
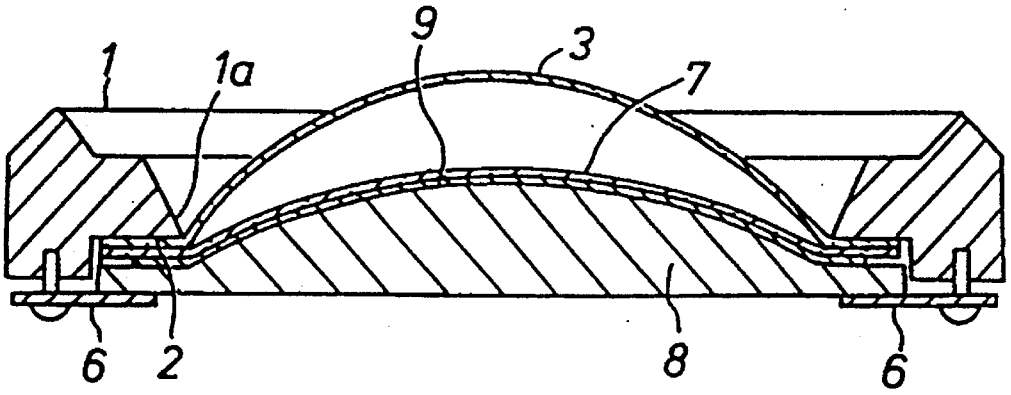
FIG. 4 is a sectional view of the assembled state of the second embodiment of the photograph stand according to the present invention.

FIGS. 3 and 4 show a second embodiment of the present invention. In FIGS. 3 and 4, the parts corresponding to those of the previous embodiment are denoted with like numerals. This embodiment comprises a dome-shaped transparent inner front panel 7 having a radius of curvature greater than that of the outer front panel 3. The rear panel 8 in this embodiment has a front face of a substantially complementary shape to the rear surface of the inner front panel 7. A photograph sheet 9 is placed between the inner front panel 7 and the rear panel 8.

The outer front panel 4, the inner front panel 7, the photograph sheet 9, and the rear panel 8 are placed, in that order, on the shoulder 2 defined on the rear surface of the frame 1 around the window 1*a*, and are jointly secured against the shoulder 2 by retaining pieces 6. Thus, the photograph sheet 9 is pressed between the inner front panel 7 and the rear panel 8, and is given with a dome-shape by being forced to conform to the surfaces pressed against it from two sides. The rear panel 8 may consist of a solid member as illustrated in FIG. 4, or a plate member having a dome-shape. If desired, the outer front panel 3 and the inner front panel 7 may consist of a single front panel.

To allow the photograph sheet 9 to more readily deform to the dome-shape without making creases in the photograph sheet 9 particularly around its periphery, the front surface of the rear panel 8 and the rear surface of the inner front panel 7 may be corrugated in a radial pattern as illustrated in FIG. 5A or the photograph sheet 9 may be provided with a plurality of radial slits 9*a* as illustrated in FIG. 5B.

According to these embodiments, the front surface of the photograph sheet or panel is provided with a convex shape, and a sense of a depth can be created so that the view may obtain a three-dimensional impression. In particular, when the photograph stand is viewed from an oblique angle or while the viewer is moving with respect to the photograph stand, the three-dimensional impression is pronounced. If desired, the contour of the photograph sheet or plate may be modified locally.

Figure 7:
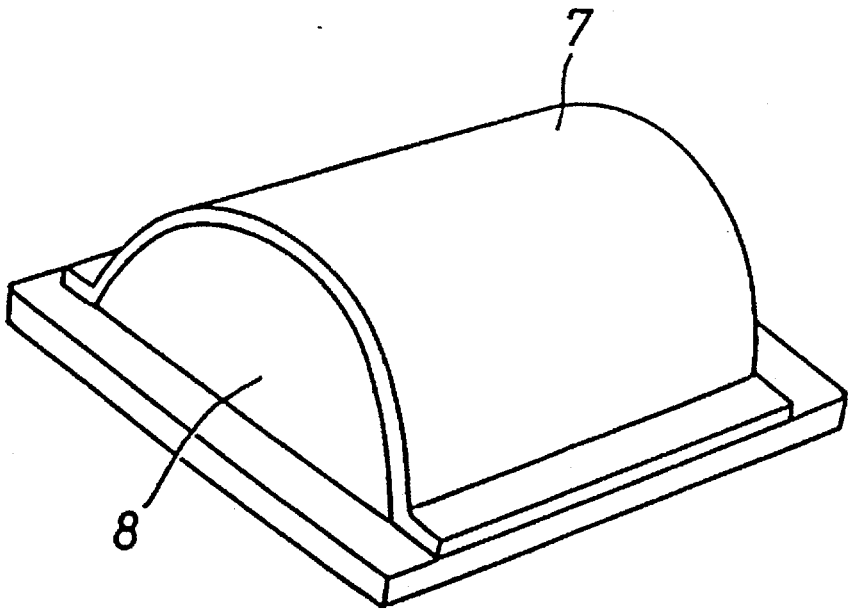
FIG. 7 is a perspective view of a fourth embodiment of the photograph stand according to the present invention.

In the preceding embodiments, the frames were oval shaped, but may also be rectangular as illustrated in FIG. 6 (third embodiment). Also, instead of forming the photograph sheet into a semi- or part-spherical shape, the photograph sheet along with the associated front and rear panels may be provided with a semi- or part-cylindrical shape as illustrated in FIG. 7 (fourth embodiment).

Figure 8:
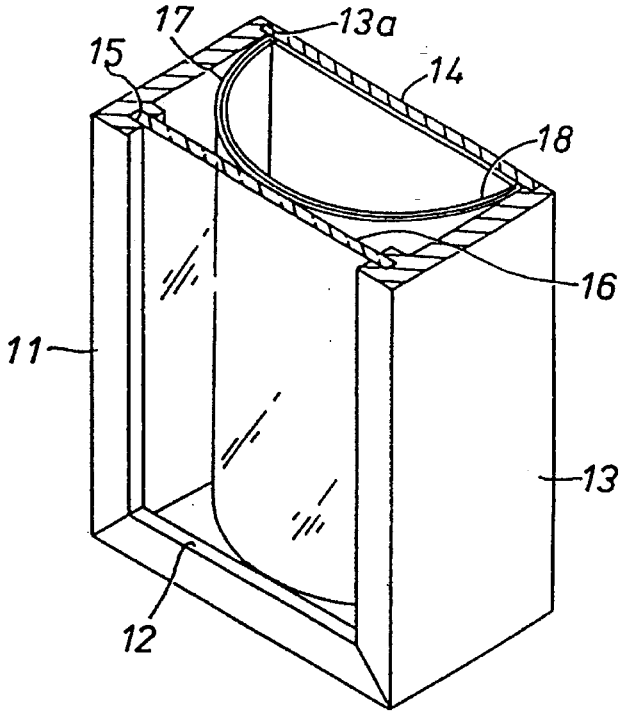
FIG. 8 is a perspective view, partly in section, of a fifth embodiment of the photograph stand according to the present invention.
Figure 9:
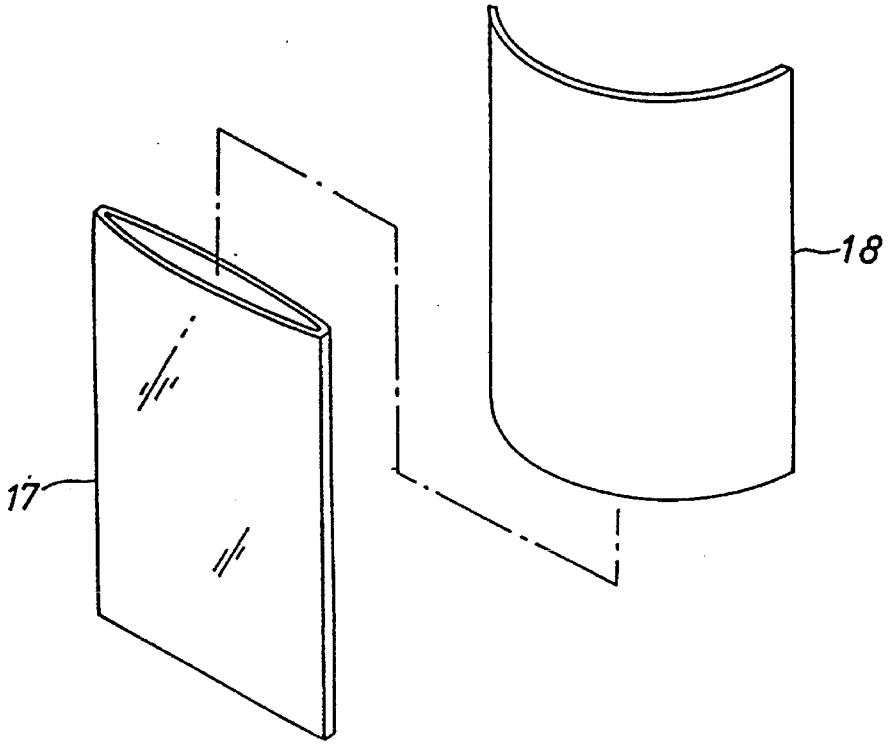
FIG. 9 is an exploded perspective view showing how a photographic sheet 18 is received in a transparent tubular sheet 17 and maintained in a curved configuration in the photograph stand illustrated in FIG. 8.

According to a fifth embodiment illustrated in FIGS. 8 and 9, a box shaped frame 11 consisting of four panels, or an upper panel (not shown in the drawing), a lower panel and a pair of side panels 13, and is provided with a window 12 on its front face, and a front panel 16 consisting of a transparent planar panel made of glass or plastics is fitted into this window 12 via slots 15 provided on either side of the window 12. A photograph sheet 18 is received in a transparent tubular sheet 17. Because the circumferential length of this transparent tubular sheet 17 is substantially less than twice the width of the photograph sheet 18, the photograph sheet 18 is curved as illustrated in FIG. 8. More specifically, if the circumferential length of the transparent tubular sheet 17 L is less than 2 w where w is the width of the photograph sheet 18, the photograph sheet 18 will be deformed into a semi- or part-cylindrical shape when it is placed into the transparent tubular sheet. In particular, if $L=w(1+2/\pi)\approx 1.64$ w, the photograph sheet will attain a substantially semi-cylindrical shape, or a one-half of a full cylindrical shape.

The rear face of the frame 11 is open, and is provided with a shoulder 13*a* around its periphery. A rectangular rear panel 14 rests on this shoulder 13*a*, and is secured thereto by retaining pieces not shown in the drawings. Thus, the rear panel 14 confines the photograph assembly consisting of the transparent tubular sheet 17 and the photograph sheet 18 inside the cavity defined in the frame 11 from the rear. If desired, the inner surface of the side panels 13 may be provided with mirror surfaces so that the photograph may acquire the impression of an increased lateral width in addition to the impression of a depth.

Thus, according to this embodiment, the photograph sheet 18 can be formed into a semi- or part-cylindrical shape with extremely simple means. Obviously, the curvature of the photograph sheet 18 can be varied at will simply by changing the circumferential length of the transparent tubular sheet 17 relative to the lateral width of the photograph sheet 18. Also, the photograph sheet 18 is not required to be permanently deformed so that it can be taken out from a photograph album to be placed in the photograph stand, and taken back into the photograph album to suit the user's wish.

Figure 10:
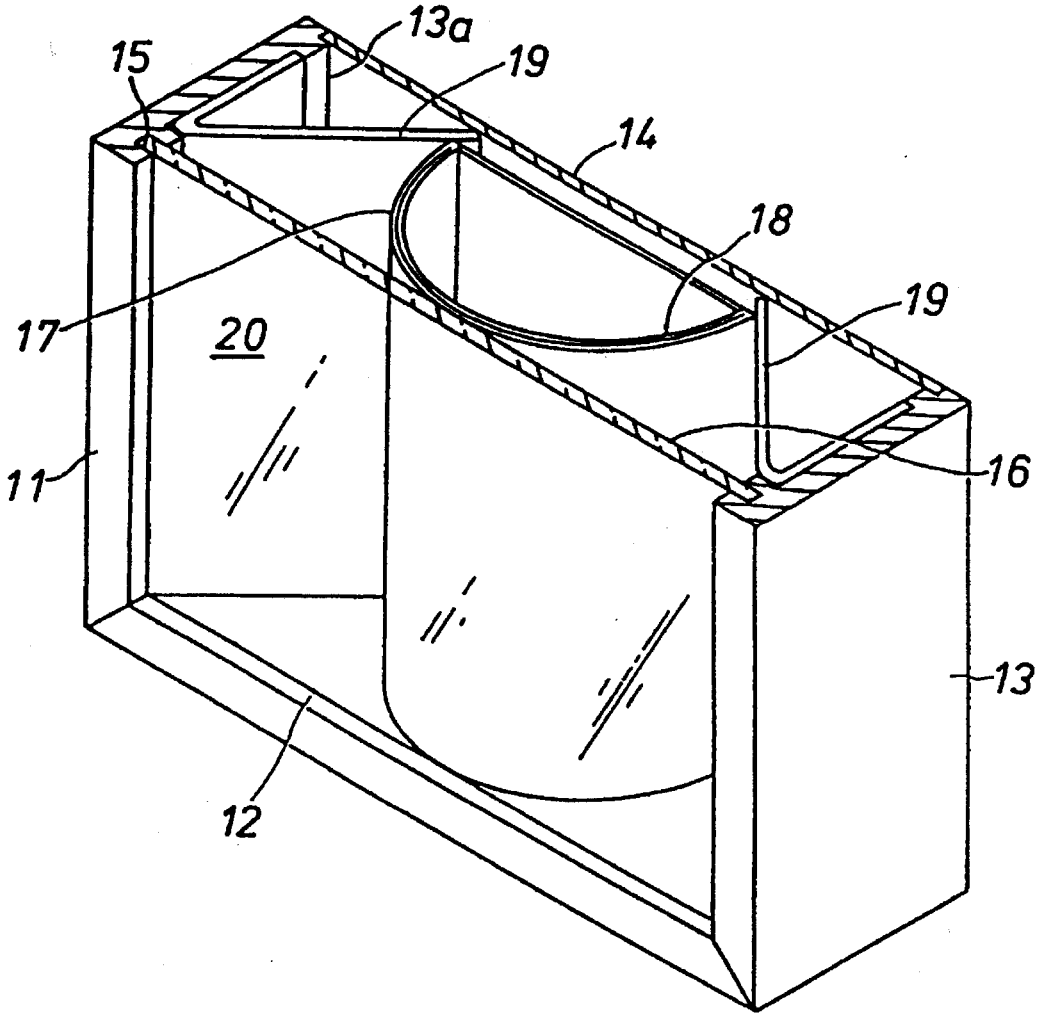
FIG. 10 is a perspective view, partly in section, of a sixth embodiment of the photograph stand according to the present invention.

FIG. 10 illustrates a sixth embodiment of the present invention which is similar to the previous embodiment. In FIG. 10, the parts corresponding to those of the previous embodiment are denoted with like numerals. In this embodiment, the frame 11 is laterally more extended than that of the fifth embodiment, and a pair of side plates 19 are arranged inside the frame 11 on either side of the semi-cylindrical photograph assembly at an oblique angle. The front surfaces of these side plates 19 are provided with mirror surfaces 20, for instance by placing a reflective metallic foil on them. The angle of the side plates 19 are so determined that the images reflected by the mirror surfaces 20 appear as an extension of the real image of the photograph sheet 18.

According to this embodiment, the viewer can obtain the impression of a depth and a width which extend beyond the physical depth and the width of the frame.

Figure 11:
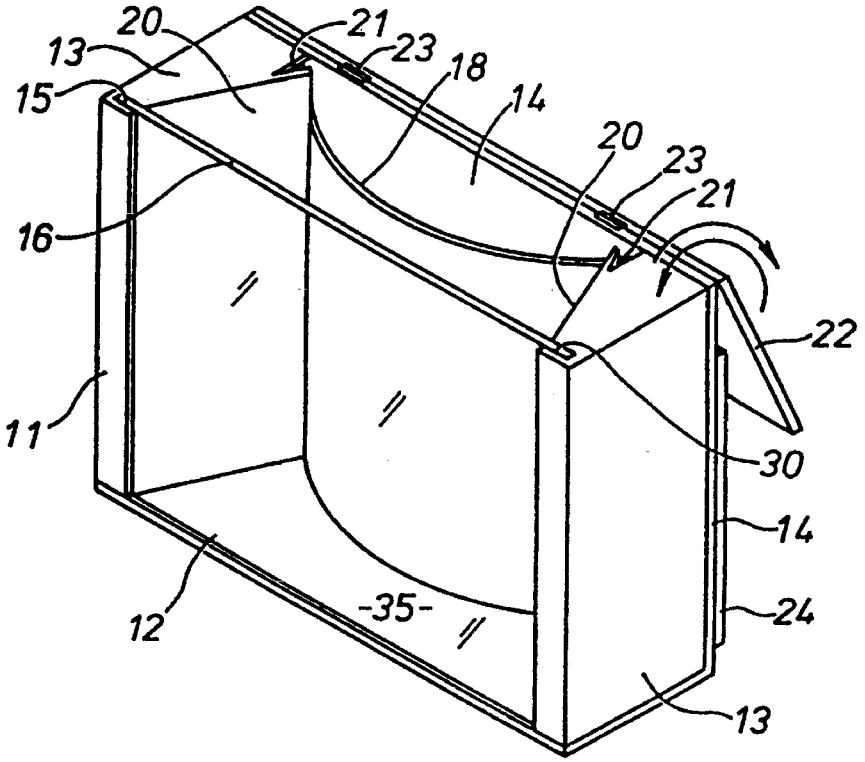
FIGS. 11 and 12 are front and rear perspective views showing a seventh embodiment of the photograph stand according to the present invention.
Figure 12:
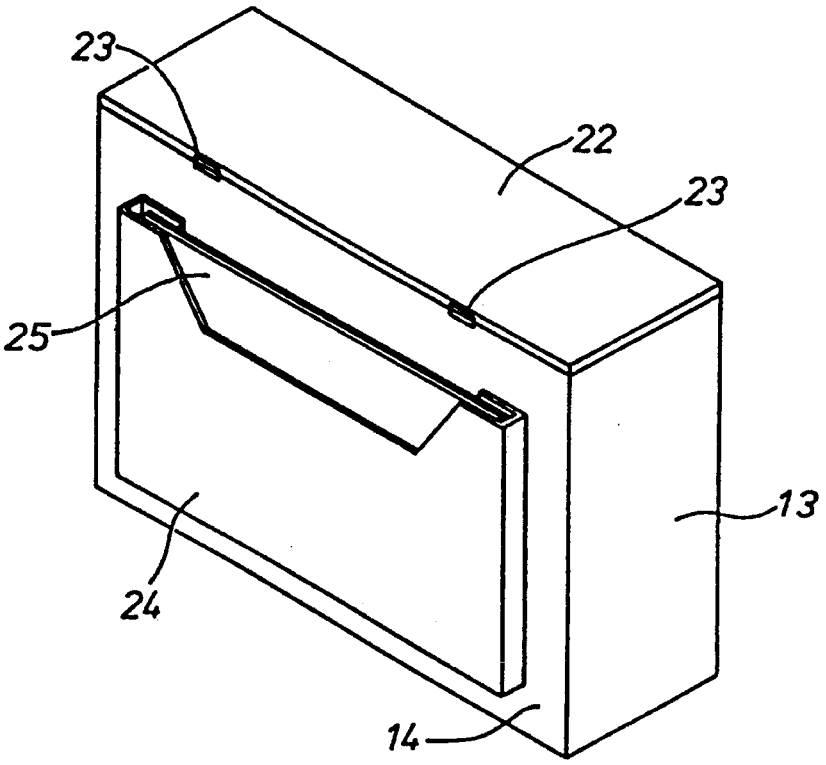

FIGS. 11 and 12 show a seventh embodiment of the present invention which can increase both the perceived depth and width of a photograph. In FIGS. 11 and 12, the parts corresponding to those of the previous embodiments are denoted with like numerals. The photograph stand of the seventh embodiment comprises a frame 11 including a bottom panel 35 and a rear panel 14. A top panel 22 is hinged to the upper end of the rear panel 14 by hinges 23. The two sides of this frame 11 are closed by side panels consisting of retaining blocks 13. The retaining blocks 13 are each provided with an external surface which defines a rectangular profile of the frame 11 and an oblique inner surface 20 which fans out from the rear to the front. The inner surfaces 21 are provided with mirror surfaces, and function in a substantially same way as the mirror surfaces 20 of the previous embodiment.

The rear end of the inner surface 20 of each of the retaining blocks 13 is provided with a notch 21 extending over the entire length of the retaining block 13. In this embodiment, a photograph sheet 18 having a width substantially greater than the distance between the rear ends of the inner surfaces 20 of the retaining blocks 13 or the distance between the two notches 21 so that when the two side edges of the photograph sheet 18 are engaged by the two notches 21, the photograph sheet 11 is deformed into a semi- or part-cylindrical shape as illustrated in FIG. 11.

If the photograph sheet 18 is not provided with a sufficient resiliency to be deformed into a semi- or part cylindrical shape and retain its shape, it is possible to use a transparent front panel and/or a rear panel made of sufficiently resilient material and provided with a greater lateral dimension that the distance between the two notches 21 to retain the photograph sheet 18 is a curved state.

Thus, according to this embodiment, the photograph sheet 11 can be formed into a three-dimensional contour without requiring any embossing or other deforming means. Furthermore, the placement of the photograph in this stand would not cause any permanent deformation, and the photograph may be returned back into a photograph album to change the photograph to another one as desired. The hinged top panel 22 allows the photograph to be easily and readily replaced. Optionally, as illustrated in FIG. 12, a pocket 24 may be provided in the back of the rear panel 14 to keep one or more than one photographs 25 therein so that the photograph on display may be readily replaced with those kept in the pocket 24 as desired.

Figure 13:
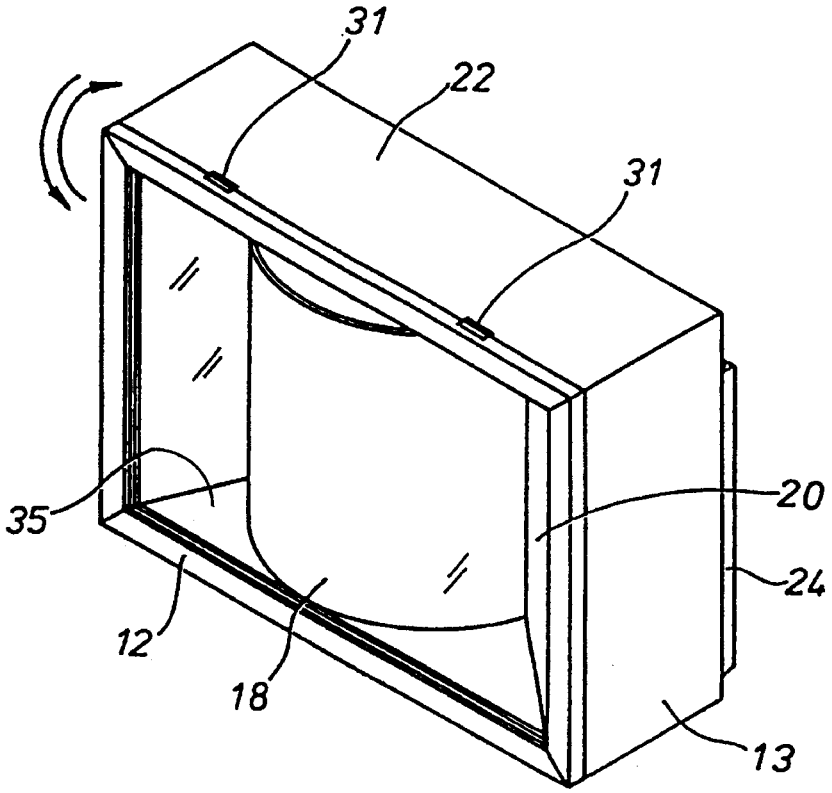
FIG. 13 is a perspective view of an eighth embodiment Of the photograph stand according to the present invention.
Figure 14:
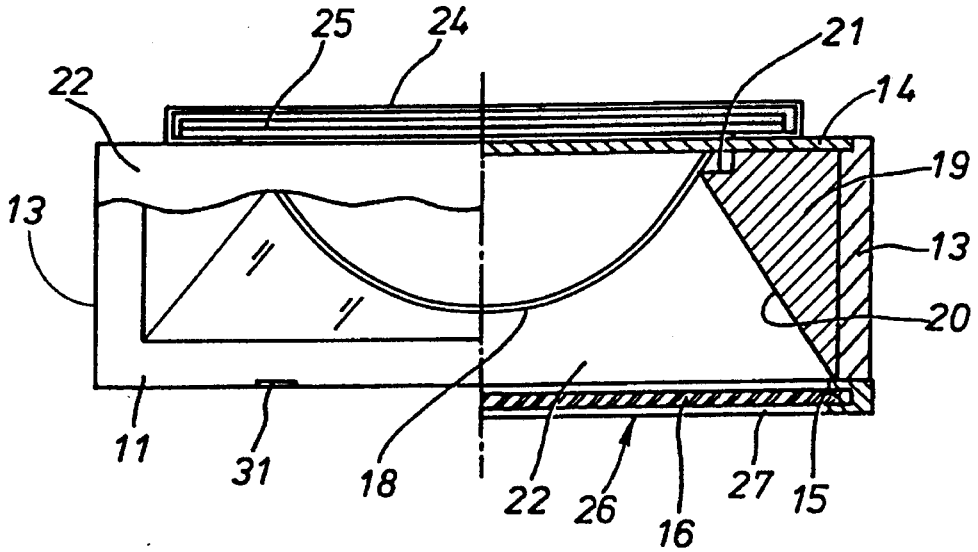
FIG. 14 is a plan view of the photograph stand of FIG. 13 with its right hand half shown in section and the left hand half cut-away with the front window removed.

FIGS. 13 and 14 illustrate an eighth embodiment which is similar to the seventh embodiment. In FIGS. 13 and 14, the parts corresponding to those of the previous embodiment are denoted with like numerals. In this embodiment, the top panel 22 of the frame 11 is fixed while the front window 12 is hinged to the front end of the top panel 22 by hinges 31. The overall glass plate 16, grooves 15 and lower edge 27 of window 12 is denoted by numeral 26 in FIG. 14.

According to this embodiment, the photograph sheet 18 can be readily installed by opening up the front window 12 and engaging the side edges of the photograph sheet 18 with the notches 21 so that the front surface of the photograph sheet 18 may present a convex semi-cylindrical surface. If desired, the front window 12 may be slidable either vertically or laterally, instead of being hinged, for the purpose of allowing access to the photograph sheet 18.

Figure 15:
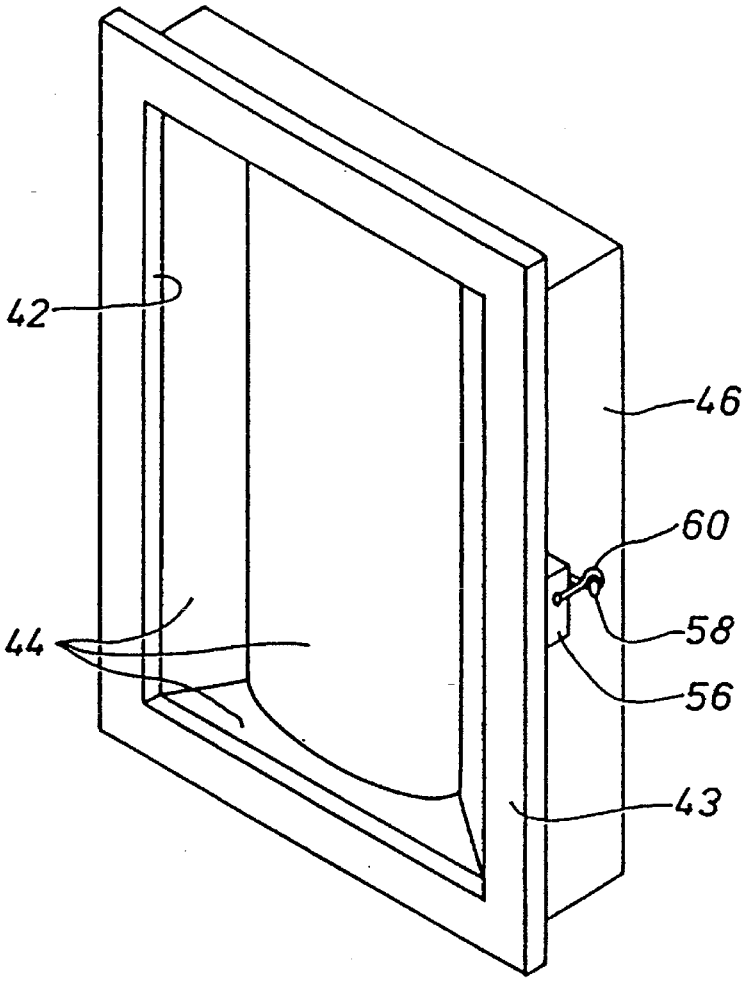
FIG. 15 is a perspective view of a ninth embodiment of the photograph stand according to the present invention.
Figure 16:
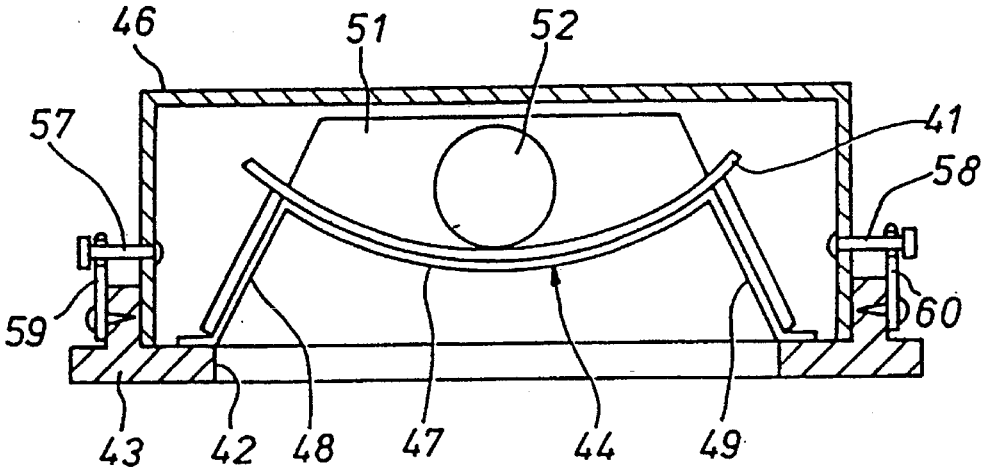
FIG. 16 is a sectional plan view of the photograph stand of FIG. 15.
Figure 17:
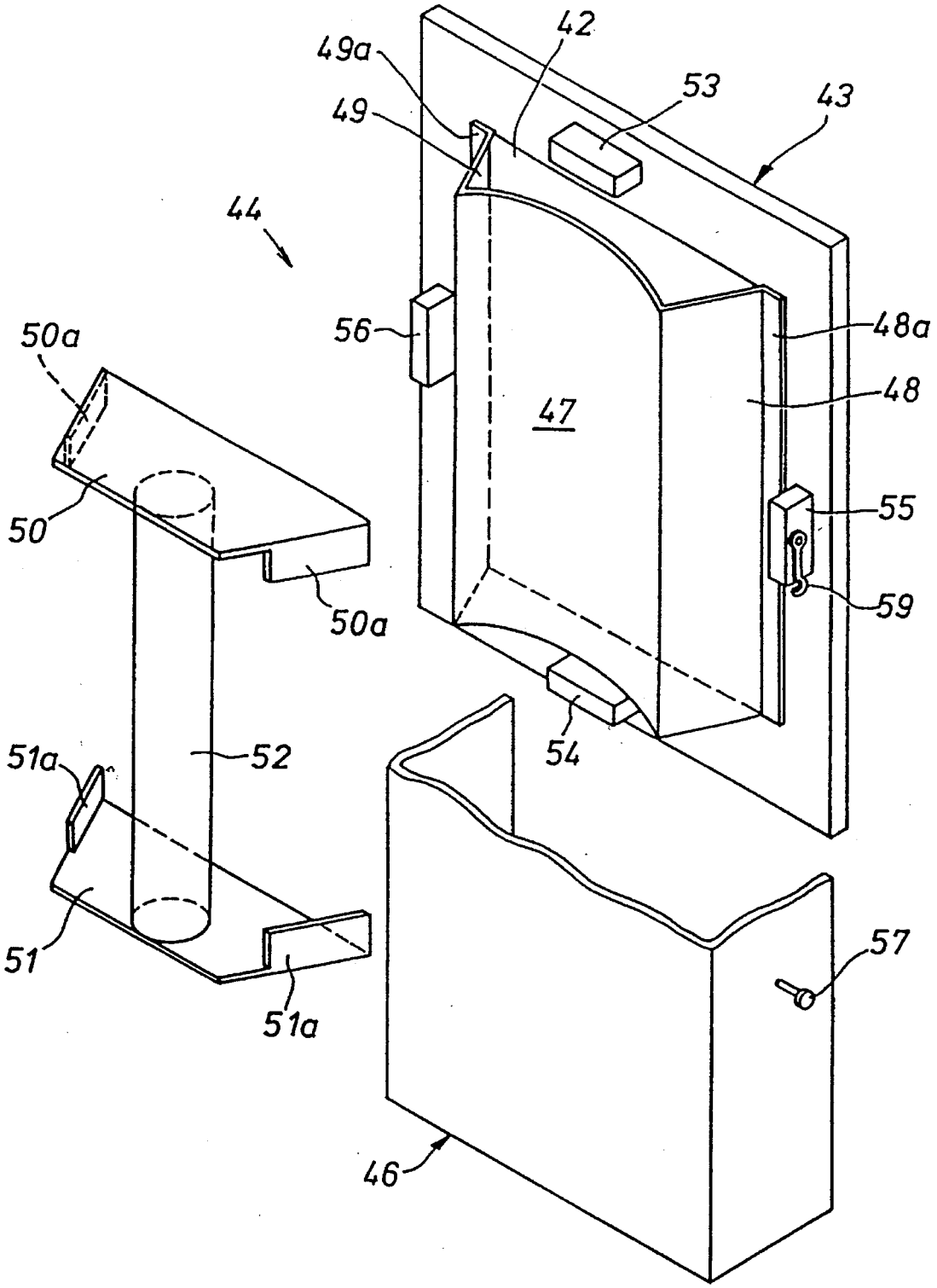
FIG. 17 is an exploded perspective view of the photograph stand of FIG. 15.
Figure 18A:
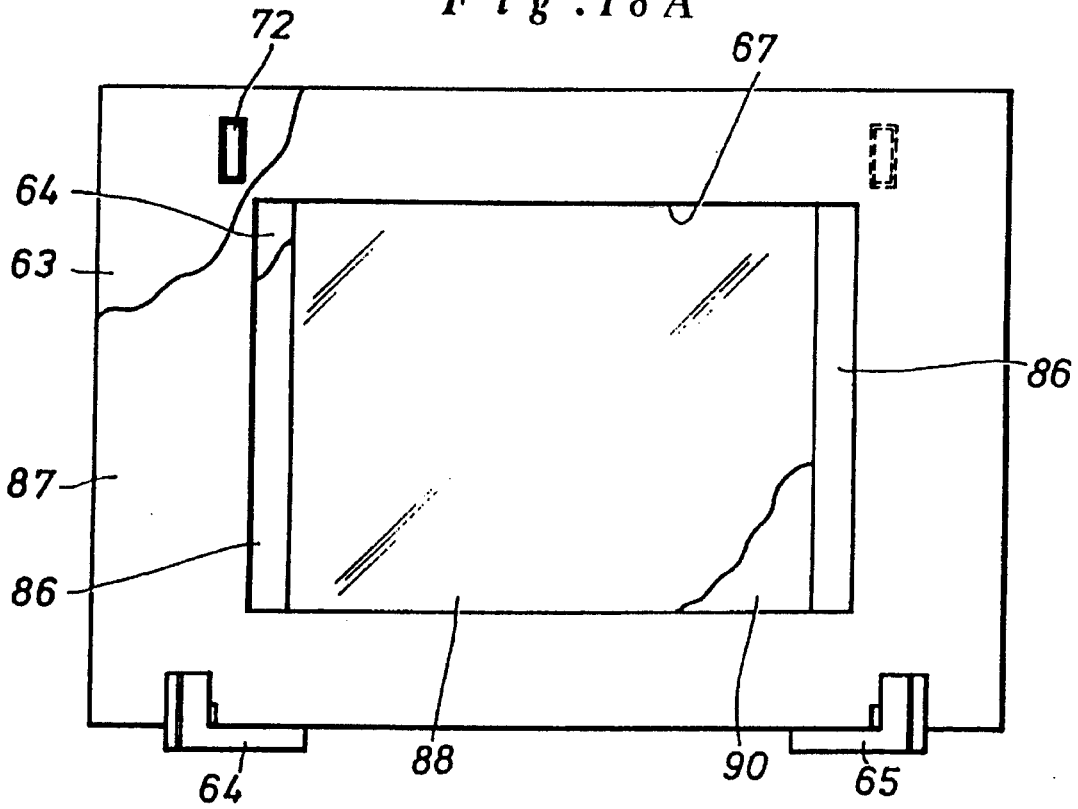
FIG. 18A is a front view of a tenth embodiment of the photograph stand according to the present invention.
Figure 18B:
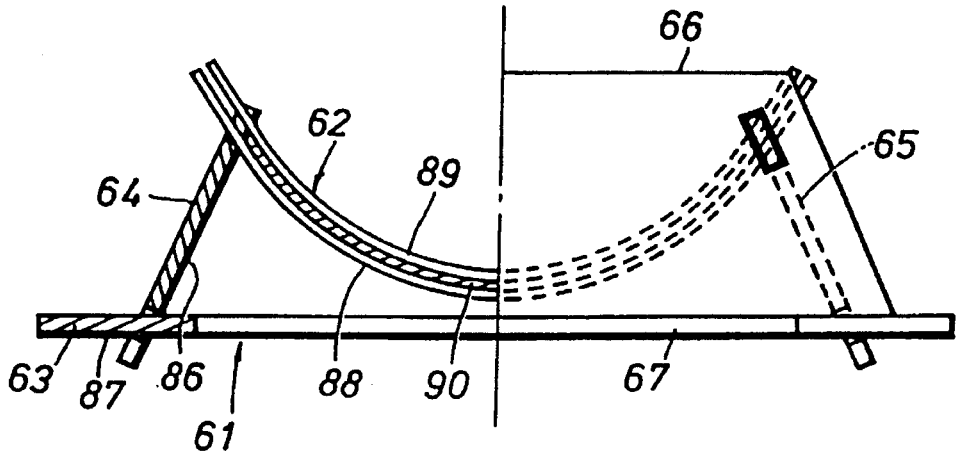
FIG. 18B is a plan view of the photograph stand of FIG. 18A with its left hand half shown in section.
Figure 19:
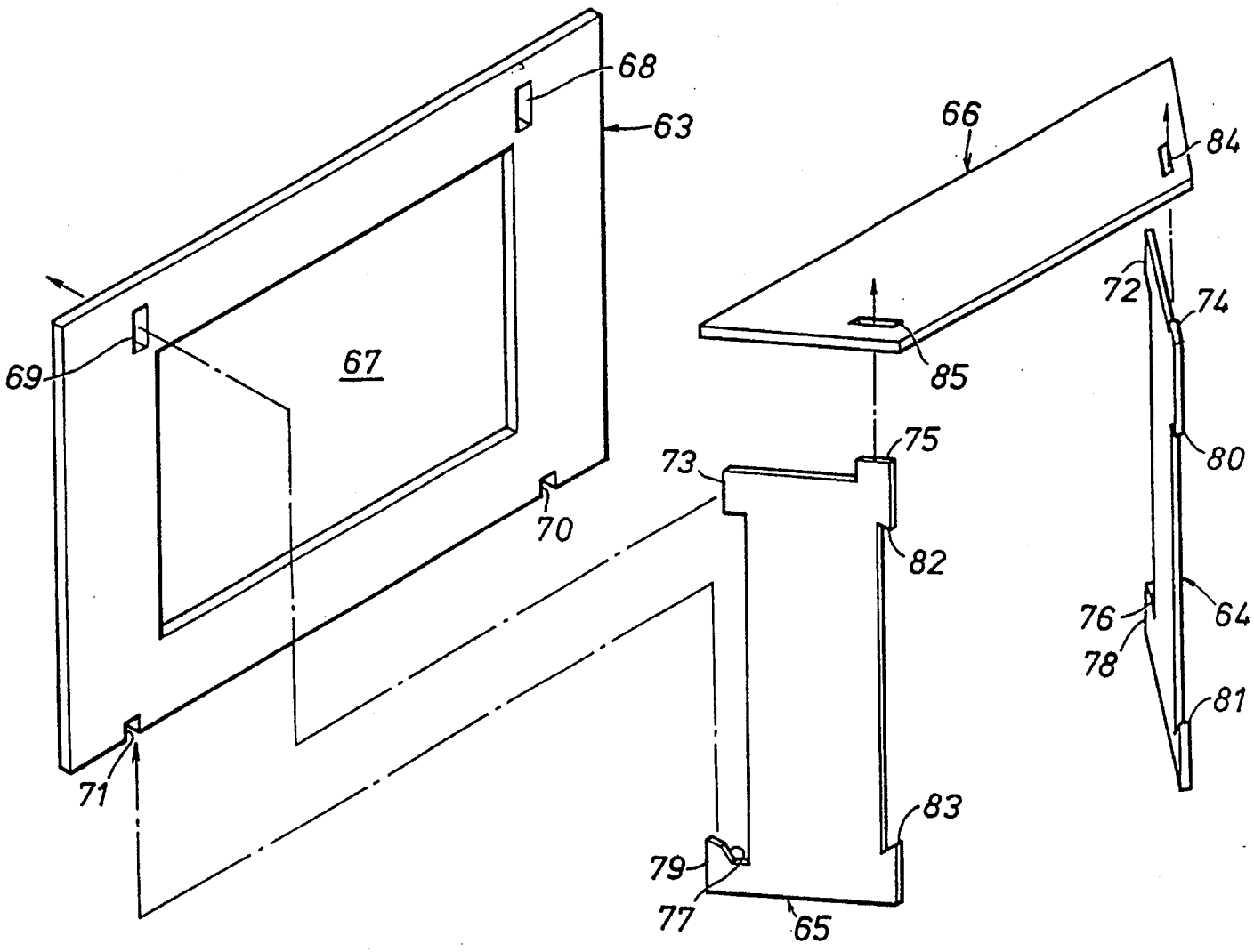
FIG. 19 is an exploded perspective view of the photograph stand of FIG. 18.

FIGS. 15 through 17 show a ninth embodiment of the present invention which is simple in structure and easy to assemble. This photograph stand comprises a front panel 43 having a window 42 for showing through a photograph sheet 41, a photograph holder assembly 44 for retaining the photograph sheet 41 in its semi- or part-cylindrically deformed state as described hereinafter, and a rear cover 46 adapted to be mounted to the rear surface of the front panel 43 and enclose the photograph holder assembly 44 therein.

The photograph holder assembly 44 comprises a transparent shaping panel 47 having a semi-cylindrical convex front surface, a pair of side plates 48 and 49 extending from either side of the shaping panel 47 at an oblique angle or fanning out from the two side edges of the shaping panel 47 and provided with mirror surfaces, mounting plates 50 and 51 adapted to be secured to the upper and lower ends of the shaping plate 47 and the side plates 48 and 49, and a hollow shaping column 52 extending between the upper and lower mounting plates 50 and 51.

The side plates 48 and 49 are provided with flanges 48*a* and 49*a* for fixedly securing the side plates 48 and 49 to the rear surface of the front panel 43, for example with a bonding agent. The mounting plates 50 and 51 are also provided with flanges 50*a* and 51*a* for fixedly securing the mounting plates 50 and 51 to the side plates 48 and 49, for instance with a bonding agent. The inner surfaces of the mounting plates 50 and 51 consist of mirror surfaces.

A pair of engagement pins 57 extend laterally and outwardly from the side surfaces of the rear cover 46. A pair of engagement hooks 59 and 60 are pivotally attached to the front panel 43 via blocks 55 and 56 for selectively engaging the engagement pins 57 to join the rear cover 46 to the front panel 43. The blocks 55 and 56, along with similar blocks 53 and 54 secured to the rear surface of the front panel 43 serve as means for properly positioning the rear cover 46 relative to the front panel 43. The bottom part or the rear surface of this rear cover 46 is provided with means such as support legs not shown in the drawings to allow the photograph stand to be placed upright on a flat surface.

According to this embodiment, since the shaping panel 47 and the shaping column 52 can retain the photograph sheet 41 in its curved state by applying a minimum amount of pressure thereto, placing the photograph sheet 41 in this photograph stand can be achieved with a minimum effort. Furthermore, the damage to the photograph which might occur when placing a photograph into and out of the photograph stand can be minimized.

FIGS. 18 through 21 show a tenth embodiment of the present invention which is not only simple in structure and easy to assemble but also attractive in appearance. This photograph stand comprises a front panel assembly 61 and a shape retaining assembly 62.

The front panel assembly 61 comprises a front panel 63 made of wood, plastic, paper or metal board or plate, a pair of substantially rectangular side plates 64 and 65 extending rearwardly from the front panel 63, and a trapezoidal connecting plate 66 connecting the upper parts of the side plates 64 and 65. The front panel 63 is provided with a rectangular window opening 67, a pair of rectangular openings 68 and 69 at upper parts thereof, and a pair of notches 70 and 71 in the lower edge thereof, all in a symmetric fashion. The side plates 64 and 65 are shaped in a symmetric fashion, and are each provided with an upper front projection 72 or 73 adapted to be fitted into the rectangular opening 68 or 69 of the front panel 63, an upper rear projection 74 or 75 adapted to be fitted into a corresponding opening 84 or 85 provided in the connecting plate 66, and a lower front projection 78 or 79 adapted to be fitted into the notch 70 or 71 of the front panel 63. The lower front projections 78 and 79 are each provided with a hook-shaped portion 76 or 77 for securely engaging the associated side plate 64 or 65 to the front panel 63. The rear edge of each of the side plates 64 and 65 is provided with notches 80 through 83 for receiving and retaining the shape retaining assembly 62.

Thus, the front panel assembly 61 can be assembled by engaging the hook-shaped portions 76 and 77 of the side plates 64 and 65 with the notches 70 and 71 on the lower edge of the front panel 63, fitting the upper front projections 72 and 73 of the side plates 64 and 65 into the corresponding openings 68 and 69 of the front panel 63, and fitting the upper rear projections 74 and 75 of the side plates 64 and 65 into corresponding openings 84 and 85 of the connecting plate 66. The front panel assembly 61 can stand by itself on a flat surface via the lower edges of the side plates 64 and 65. Because the side plates fan out from the rear to the front, their inner surfaces 76 are visible from the window opening 67. These inner surfaces 76 are formed as mirror surfaces to achieve a same goal as the mirror surfaces of the previous embodiments. If desired, the lower edges of the side plates 64 and 65 may be joined by a lower connecting plate similar to the upper connecting plate 66.

The front panel assembly 61 is thus formed by various plate members, if desired, without using any bonding agent or any fastening means. In this case, if these plate members are taken apart and packaged in a small flat box so that the user may assemble them together after purchase, the cost for distribution and packaging may be minimized. If a particularly sturdy structure is desired, the various parts may be joined together by using a suitable bonding agent or fastening means.

Figure 20:
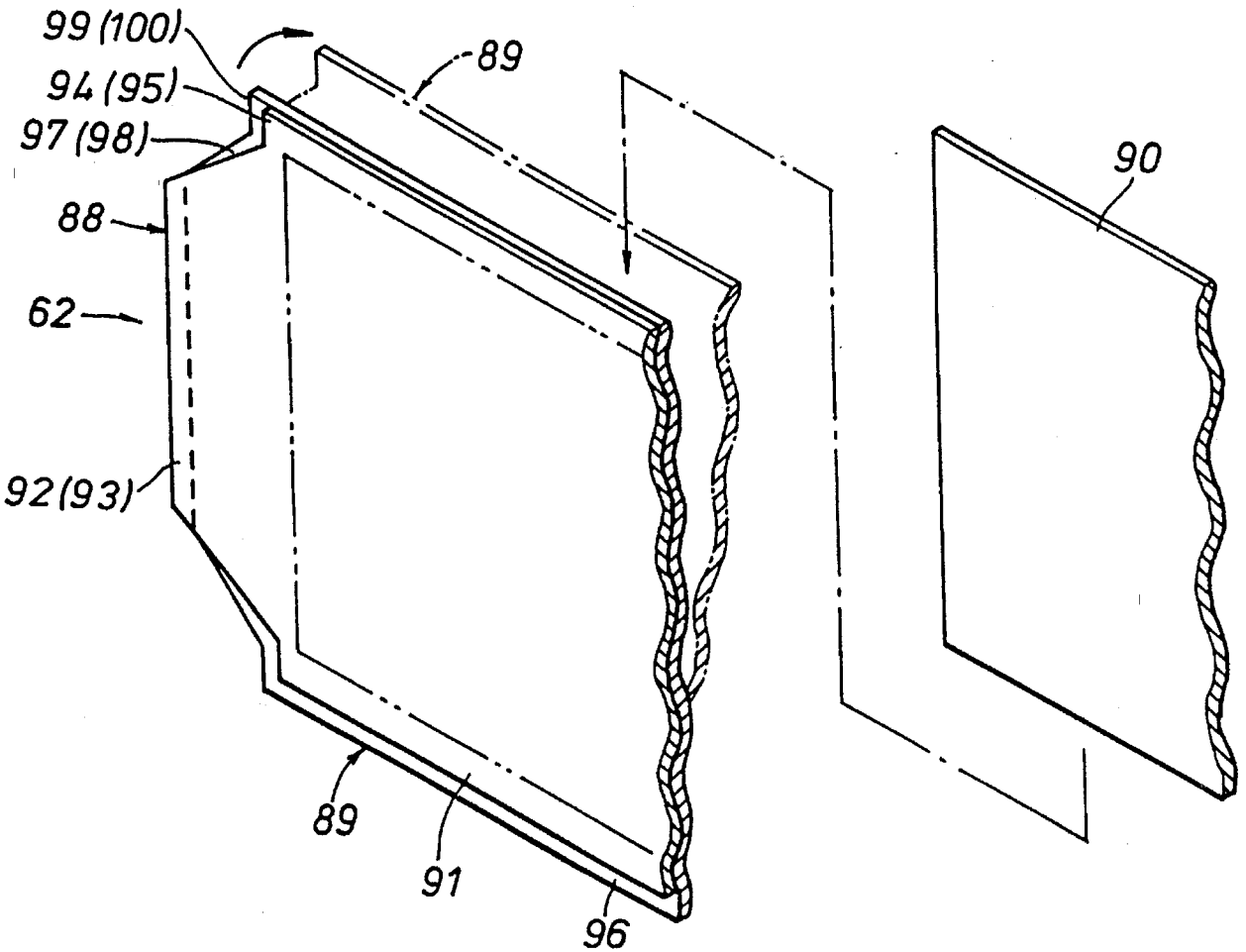
FIG. 20 is a fragmentary exploded perspective view of the shape retaining panel of the photograph stand of FIG. 18.
Figure 21:
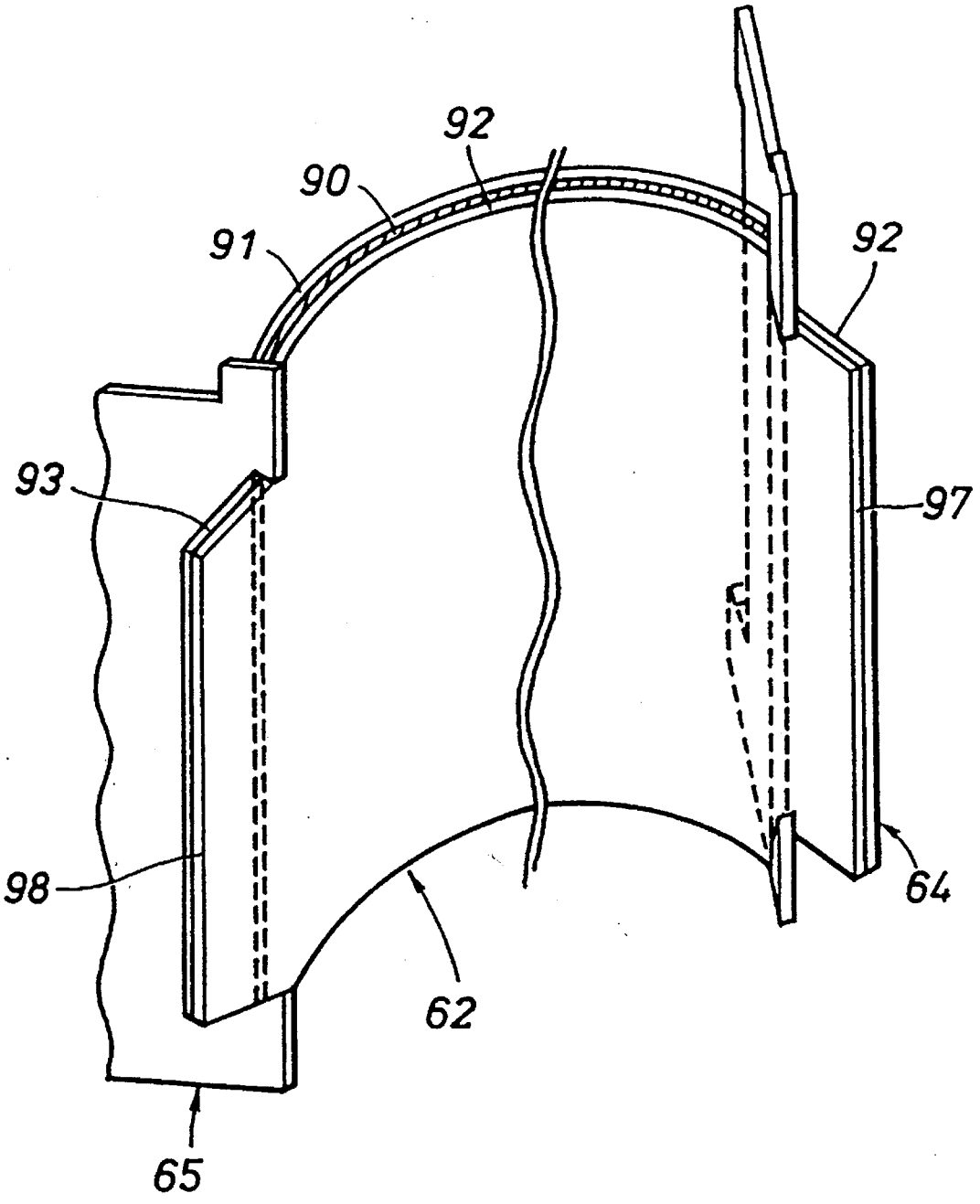
FIG. 21 is a fragmentary rear perspective view of the shape retaining panel of the photograph stand of FIG. 18.

As best illustrated in FIGS. 20 and 21, the shape retaining assembly 62 comprises a front shape retaining panel 88 and a rear shape retaining panel 89 which retain a photograph sheet 90 between them. The front shape retaining panel 88 is made of a rectangular transparent plastic sheet having a suitable resiliency, and its four corners are appropriately trimmed so that these corners may be snugly received in the notches 80 through 83 provided on the rear edges of the side plates 64 and 65. Thus, the front shape retaining panel 88 consists of a rectangular main part 91, a pair of lateral extensions 92 and 93 having a slightly reduced width (or vertical dimension), and shoulders 94 and 95 defined between these two parts having different widths.

The rear shape retaining panel 89 may consist of a either transparent or opaque plate made of plastics, wood, paper or other suitable material, and is substantially conformal to the front shape retaining panel 88, except for slight difference in shape for the purpose of facilitating the separation of the rear shape retaining panel 89 from the front shape retaining panel 88 by the user. Thus, the rear shape retaining panel 89 consists of a rectangular main part 96, a pair of lateral extensions 97 and 98 having a slightly reduced width (or vertical dimension), and shoulders 99 and 100 defined between these parts.

According to this embodiment, the lower edges of the front and rear shape retaining panels 88 and 89 are joined together by a bonding agent or the like, and can receive a photograph sheet 90 between them by opening the upper end of the shape retaining assembly 62. With the photograph sheet 90 placed between the front and rear shape retaining panels 88 and 89, the shape retaining assembly 62 is secured to the rear edges of the side plates 64 and 65 with the lateral extensions 92, 93, 97, and 98 fitted into the notches 80 through 83 provided on the rear edges of the side plates 64 and 65.

Because the length of the main parts 91 and 96 of the front and rear shape retaining panels 88 and 89 (or the horizontal distance between the shoulders 94, 95, 99, and 100 defined between the extensions 92, 93, 97, and 98 and the main parts 91 and 96) is greater than the distance between the rear edges of the side plates 64 and 65, the shape retaining assembly 62, when mounted on the side plates 64 and 65, becomes curved by a curvature determined by the above mentioned dimensional difference.

This embodiment allows a photograph sheet to be curved and to be retained in the curved condition by means of a structure consisting solely of plate members, thus creating a three-dimensional effect with a highly simple structure. When the inner surfaces of the side plates are formed as mirror surfaces, the perceived width can be also expanded.

Figure 22A:
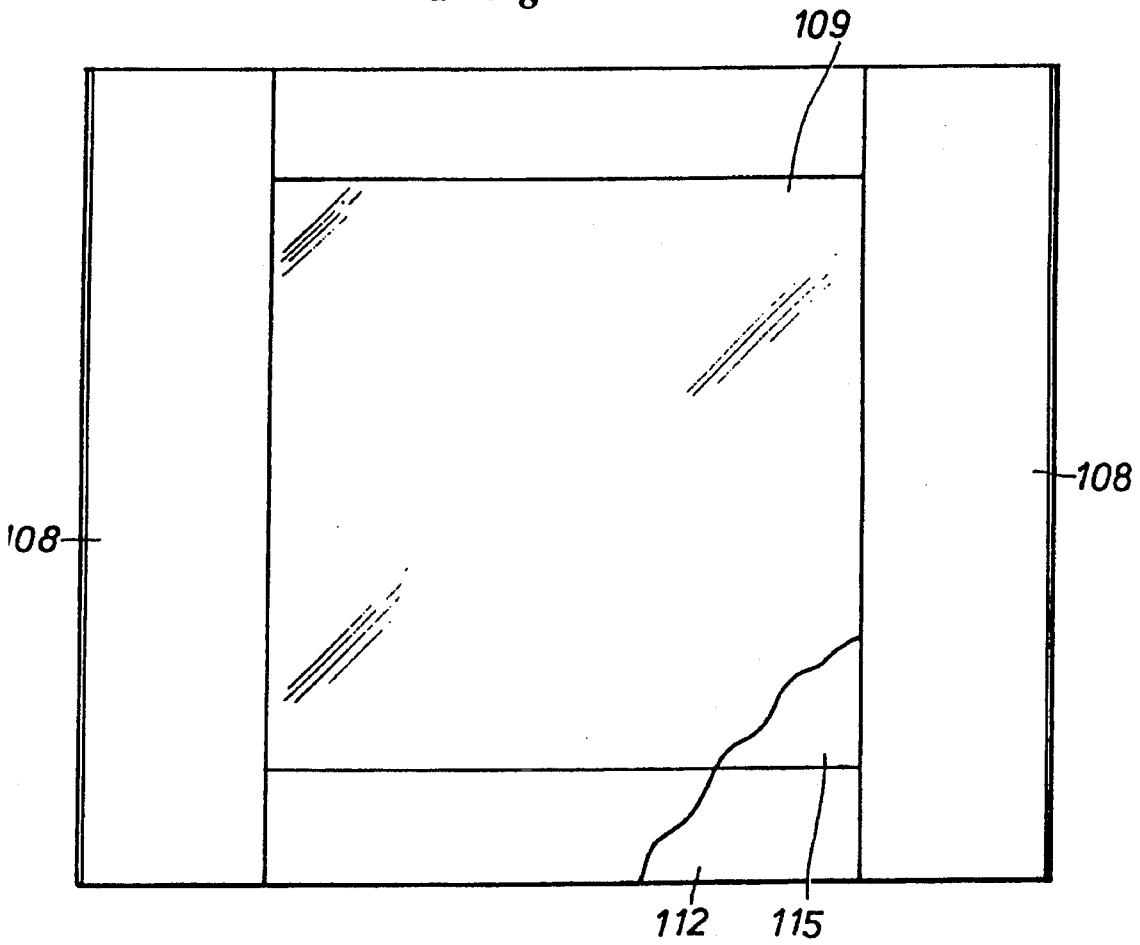
FIG. 22A is a front view of an eleventh embodiment of the photograph stand according to the present invention.
Figure 22B:
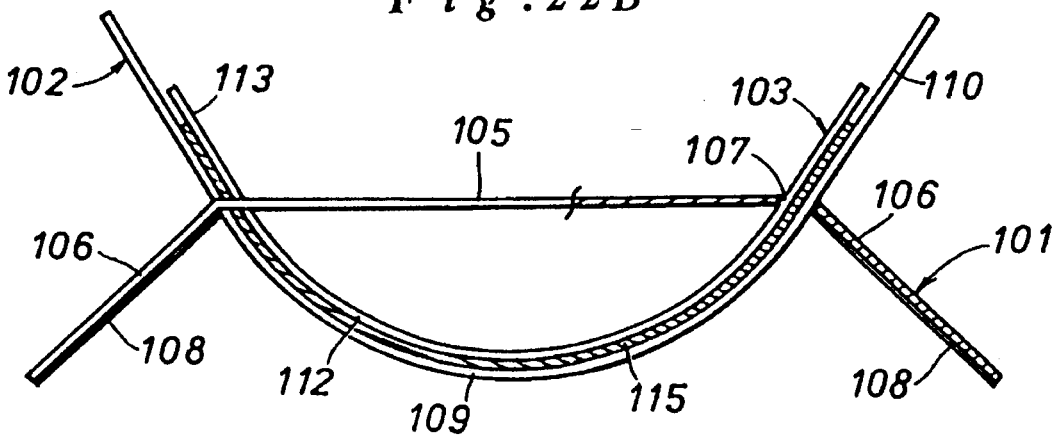
FIG. 22B is a sectional plan view of the photograph stand of FIG. 22A.

FIGS. 22 and 23 show an eleventh embodiment of the present invention which is not only simple in structure and easy to assemble but also attractive in appearance. As best illustrated in FIGS. 22 and 23, this photograph stand comprises a support panel 101, a front shape retaining panel 102, and a rear shape retaining panel 103.

Figure 23C:
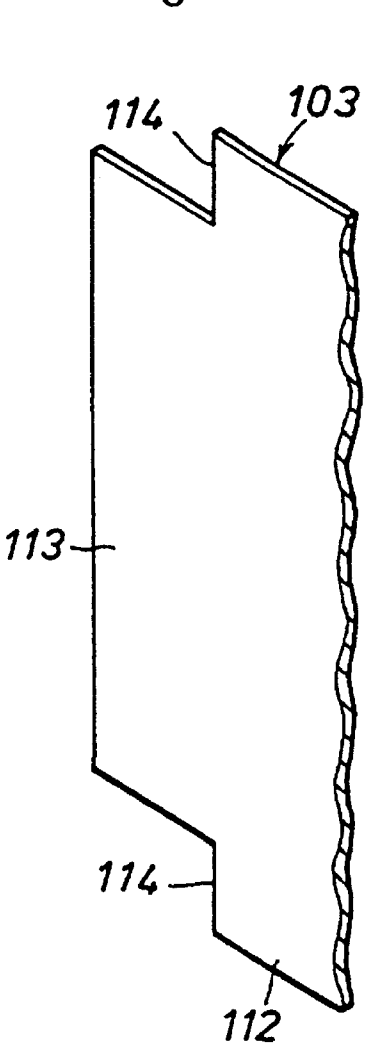
FIG. 23 is a fragmentary exploded perspective view of the shape retaining panel of the photograph stand of FIG. 22.
Figure 23B:
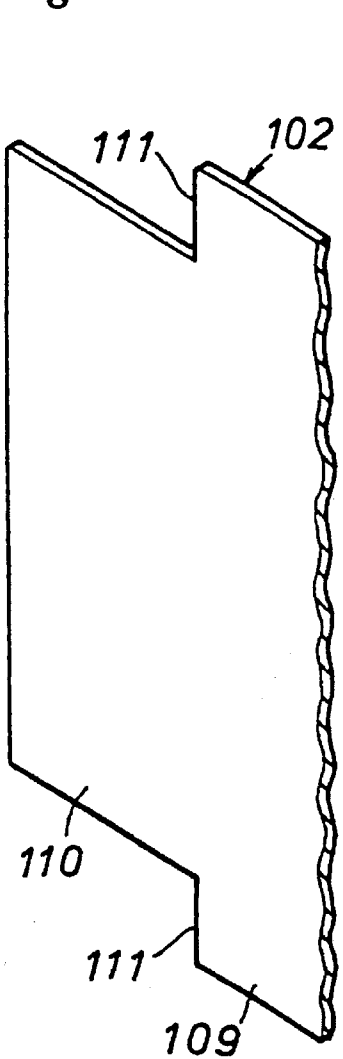
Figure 23A:
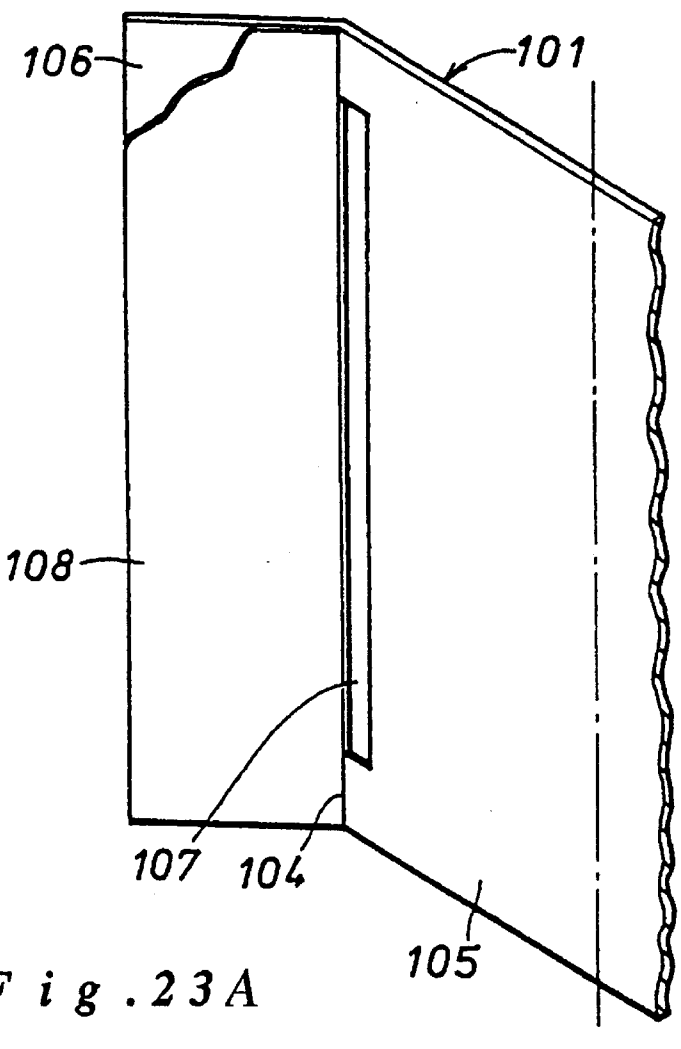

FIG. 23A shows a left hand side of the support panel 101 which is made of a rectangular plastic or paper board having a suitable rigidity, and bent along two vertical fold lines 104 so that the support panel 101 is divided into a planar central part 105 and a pair of side parts 106 which are bent along the fold lines 104 toward the viewer by the angle of 45 degrees according to this embodiment. The side edges of the main part 105 are each provided with a vertical slot 107 extending along a middle part of the corresponding fold line 104. The front surface of each of the side parts 105 may be covered by a metallic foil or the like so as to define a mirror surface 108.

FIG. 23B shows a left hand side of the front shape retaining panel 102 which is made of a rectangular transparent plastic plate having a suitable resiliency, and its four corners are suitably trimmed so that side edge portions 110 of the front shape retaining panel 102 may be fitted into the corresponding slots 107 from the front to the depth permitted by shoulders 111 defined between the side edge portions 110 and a main part 109 of the retaining panel 102.

FIG. 23C shows a left hand side of the rear shape retaining panel 103 which is made of a rectangular plastic or paper board appropriately tinted and having a suitable resiliency, and is substantially conformal to the front shape retaining panel 102. The rear shape retaining panel 103 thus has a rectangular main part 112, and a pair of side edge portions 113 adapted to be fitted into the vertical slots 107 of the support panel 101, and shoulders 114 which determine the extent by which the side edge portions 113 can be fitted into the vertical slots 107.

The support panel 101 faces its concave surface toward the viewer, and with a photograph sheet 115 placed between the front and rear shape retaining panels 102 and 103, the side edge portions 109 and 112 are fitted into the vertical slots 107 of the support panel 101. Because the horizontal distances between the shoulders 111 and 114 are greater than the distance between the two vertical slots 107, the front and rear shape retaining panels 102 and 103, along with the photograph sheet 115 retained between them, are curved by an appropriate curvature with their convex surface facing the front or the viewer.

This embodiment also allows a photographic sheet to be curved and to be retained in the curved condition by means of a structure consisting solely of plate members, thus creating a three-dimensional effect with a highly simple structure. When the inner surfaces of the side parts 106 are formed as mirror surfaces, the perceived width can be expanded.

Figure 24A:
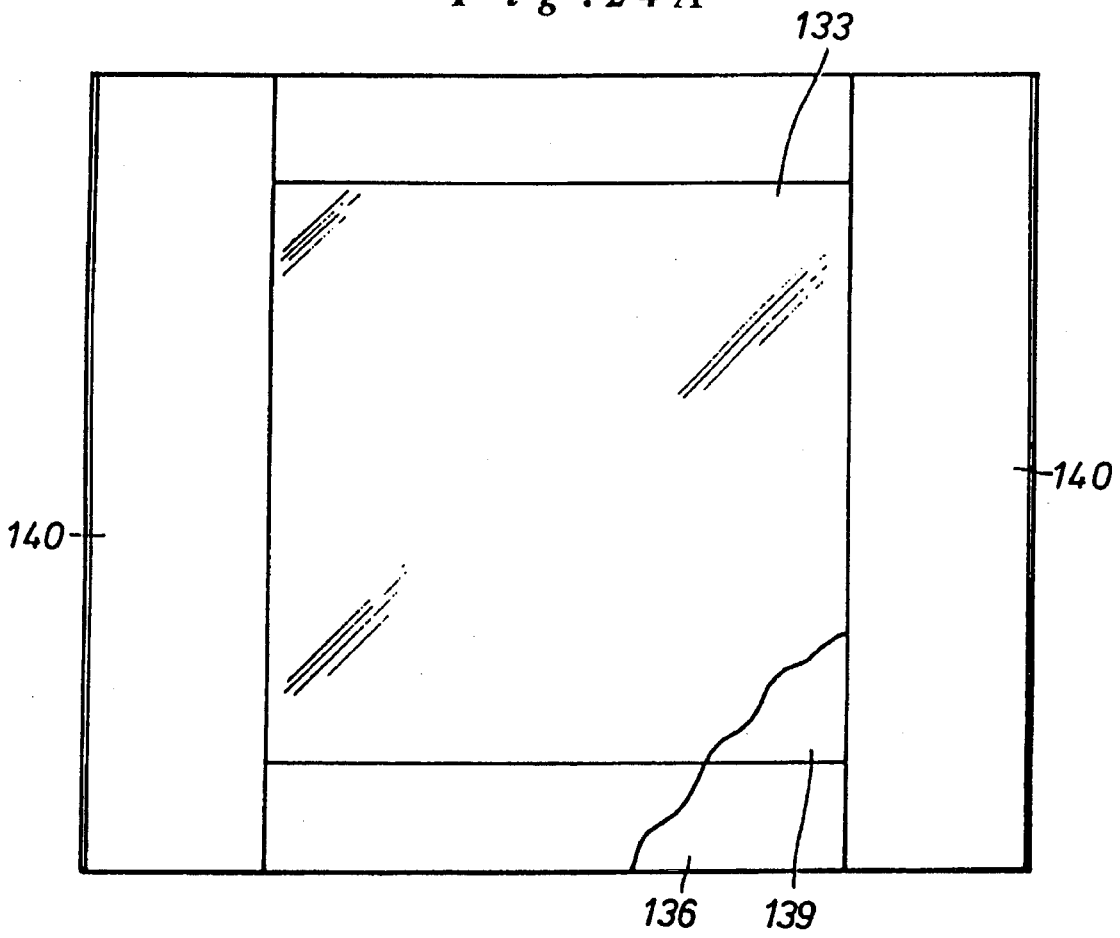
FIG. 24A is a front view of a twelfth embodiment of the photograph stand according to the present invention.
Figure 24B:
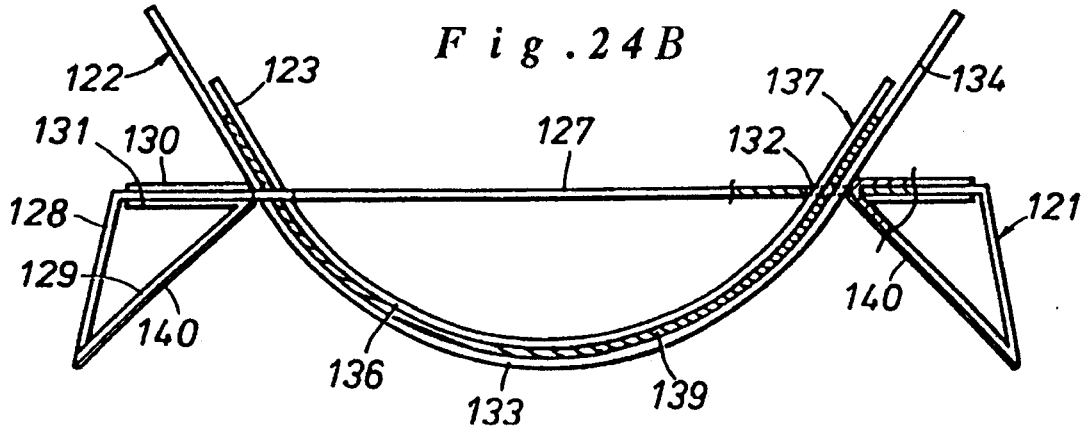
FIG. 24B is a sectional plan view of the photograph stand of FIG. 24A.
Figures 25A, 25B, 25C:
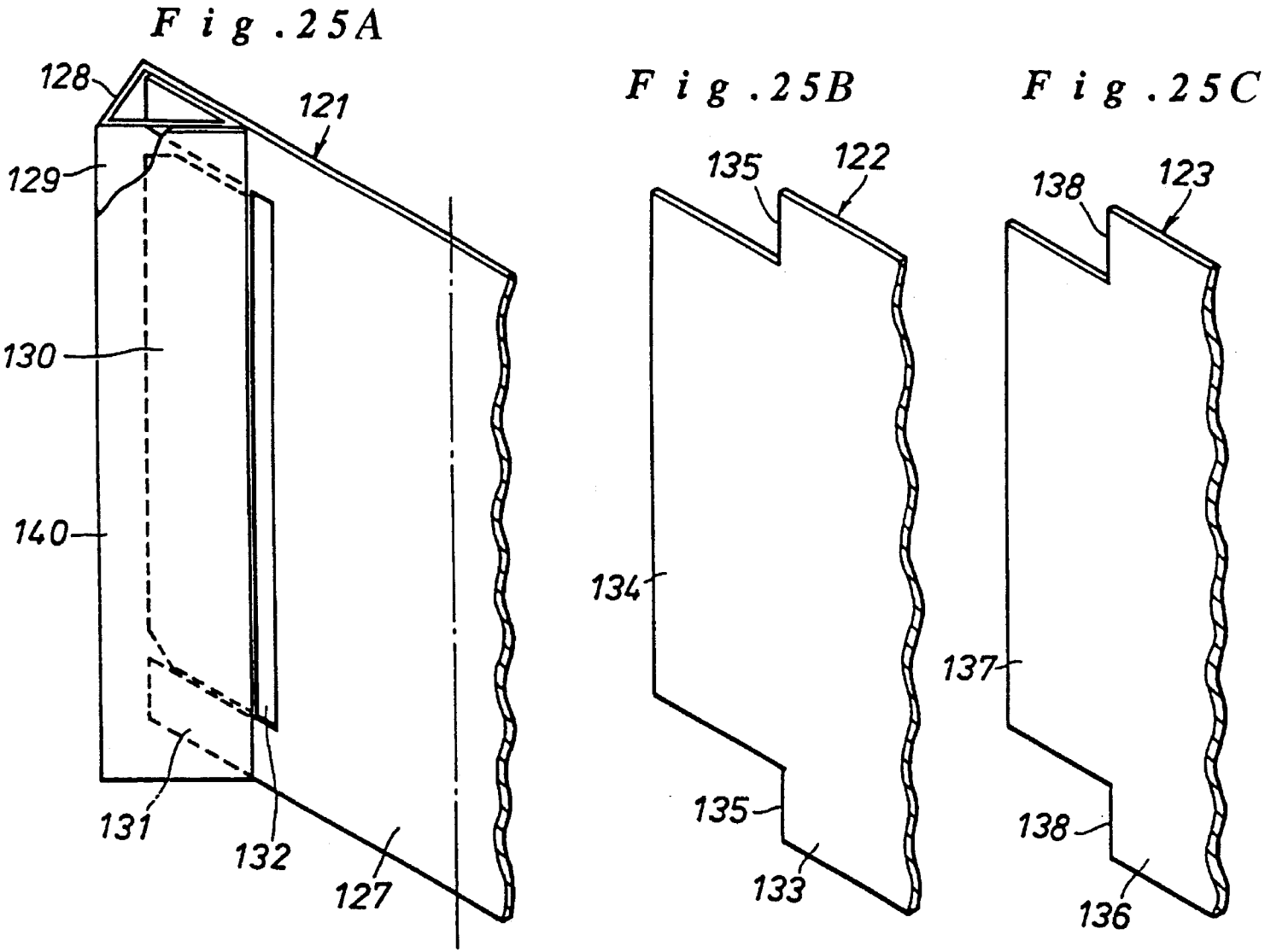
FIG. 25 is a fragmentary exploded perspective view of the photograph stand of FIG. 24.
Figure 26:
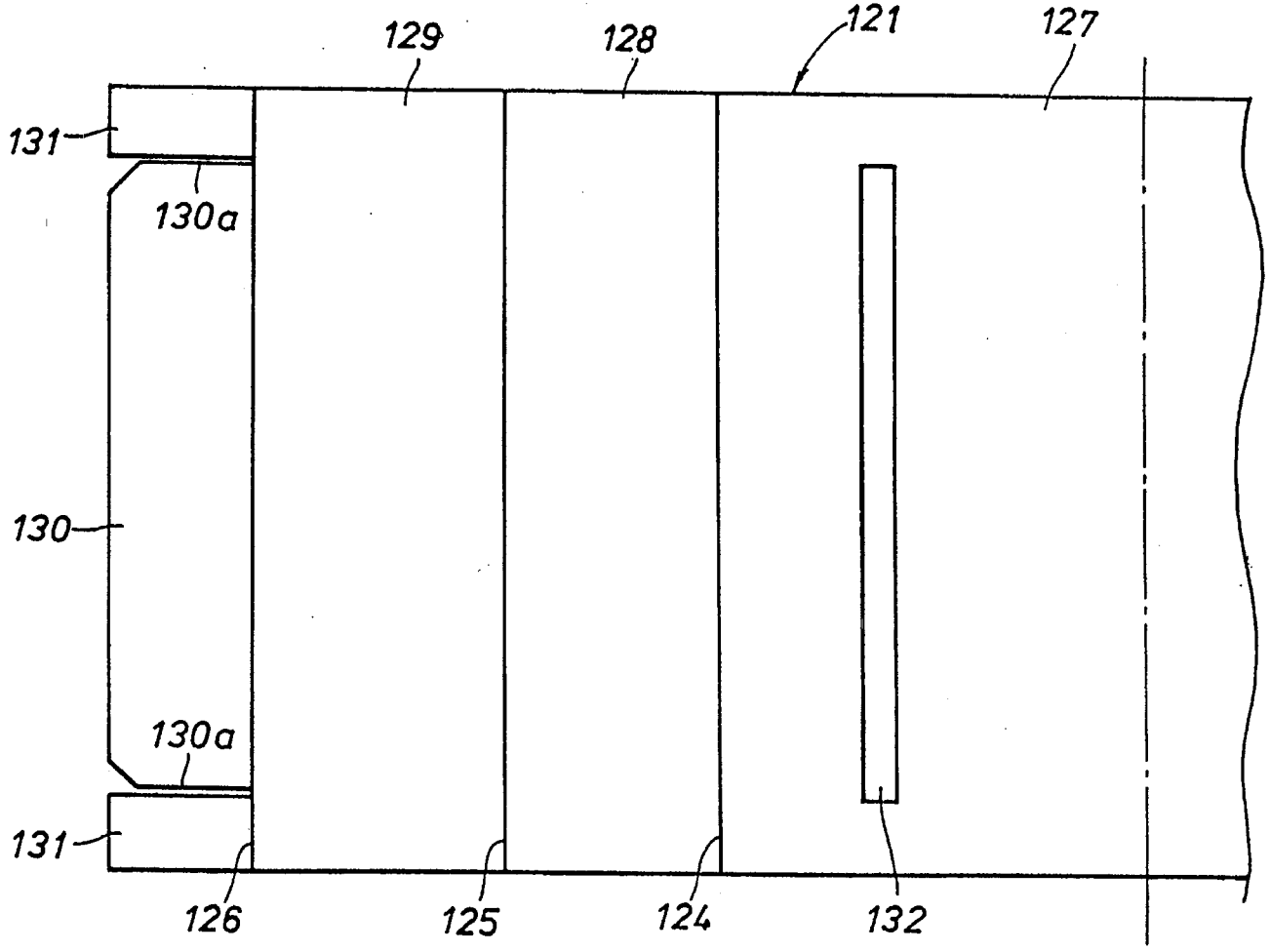
FIG. 26 is a developed view of the support panel of the photograph stand of FIG. 24.

FIGS. 24 through 26 show a twelfth embodiment of the present invention which is not only simple in structure and easy to assemble but also attractive in appearance. This photograph stand similarly comprises a support panel 121, a front shape retaining panel 122, and a rear shape retaining panel 123.

Referring to FIG. 25A and FIG. 26 showing a left hand side of the support panel 121 in a perspective view and a developed view, respectively, the support panel 121 consists of a rectangular plastic or paper board having a suitable rigidity bent along vertical fold lines 124, 125 and 126 so that a vertical columnar portion having a triangular cross section may be formed along each side edge of the support panel 121 with a pair of side plates 128 and 129 bent from a main part 127 of the support panel 121 projecting forward from the major surface of the support panel 121. The outermost edge portions of the plate member forming the support panel 121 are each provided with a pair of horizontal slits 130*a* dividing the outermost edge portion into upper and lower tongues 131 and a relatively wide middle tongue 130. The upper and lower tongues 131 are attached to the front surface of the main part 127 of the support panel 121 with a bonding agent or the like while each of the middle tongues 130 is passed through a vertical slot 132 provided in the main part 127 of the support panel 121, and attached to the rear surface of the main part 127 of the support panel 121 with a bonding agent or the like. The front surface of each of the inner side plates 129 defines a 135-degree angle with respect to the main part 127 of the support panel 121, and is provided with a mirror surface 140.

FIG. 25B shows a left hand side of the front shape retaining panel 122 which is made of a rectangular transparent plastic plate having a suitable resiliency, and its four corners are suitably trimmed so that side edge portions 134 of the front shape retaining panel 122 may be fitted into the corresponding slots 132 from the front to the depth permitted by shoulders 135 defined between the side edge portions 134 and a main part 133 of the front retaining panel 122.

FIG. 25C shows a left hand side of the rear shape retaining panel 123 which is made of a rectangular plastic or paper board appropriately tinted and having a suitable resiliency, and is substantially conformal to the front shape retaining panel 122. The rear shape retaining panel 123 thus has a rectangular main part 136, a pair of side edge portions 137 adapted to be fitted into the vertical slots 132 of the support panel 121, and shoulders 138 which determine the extent by which the side edge portions 137 can be fitted into the vertical slots 132.

With a photograph sheet 139 placed between the front and rear shape retaining panels 122 and 123, the side edge portions 134 and 137 are fitted into the vertical slots 132 of the support panel 121. Because the horizontal distances between the shoulders 135 and 138 are greater than the distance between the distance between the two vertical slots 132, the front and rear shape retaining panels 122 and 123, along with the photograph sheet 139 retained between them, are curved by an appropriate curvature with their convex surface facing the front or the viewer.

Although the photograph stand of this embodiment essentially consists of a plate member, the columnar portions provided on either side of the photograph stand gives the photograph stand an extremely high structural rigidity. In addition, this embodiment can offer the advantages mentioned in connection with the previous embodiment.

Although the present invention has been described in terms of specific embodiments thereof, it is possible to modify and alter details thereof without departing from the spirit of the present invention.

What we claim is:

1. In combination a deformable photograph or picture having a lateral width, and a photograph stand:

said stand including a frame having an outer profile and defining a window;

a support panel for mounting the photograph or picture thereon in a fixed relation to said frame so as to show the photograph or picture through said window, wherein said support panel comprising a flexible transparent sleeve for receiving the photograph or picture therein, a circumferential length of said transparent sleeve being shorter than twice the lateral width of the photograph or picture such that the mounted photograph or picture is maintained in a part-cylindrical curved condition by and in said transparent sleeve;

means in said frame for maintaining the photograph or picture and said transparent sleeve in a curved condition with a front surface of the photograph or picture defining a convex surface.

2. The combination according claim 1, wherein said frame comprises an upper panel, a bottom panel, and a pair of side panels, thus defining a substantially box-shaped configuration, and wherein the photograph or picture is received in said frame with an axial direction extending in parallel with said side panels.

3. The combination according to claim 2, wherein said side panels include oblique panels which fan out toward a viewer, said oblique panels being provided with mirror surfaces.

4. In combination a photograph or picture sheet having a certain resiliency and a lateral width, and a photograph stand:

said stand including a frame having an upper panel, a bottom panel and a pair of side panels; and engagement portions provided on rear end portions of said side panels for engaging side edges of said photograph sheet, the lateral width of said photograph sheet being greater than a lateral distance between said engagement portions;

whereby said photograph sheet is mounted on said photograph stand in a part-cylindrically curved condition with an axial line thereof extending substantially in parallel with said side panels and a front surface of said photograph sheet defining a convex surface.

* * * * *